US011732582B2

(12) United States Patent
Feng et al.

(10) Patent No.: US 11,732,582 B2
(45) Date of Patent: Aug. 22, 2023

(54) MICROWAVE PLASMA ADAPTIVE ROCK BREAKING DEVICE FOR MICRO WAVE-INSENSITIVE ROCKS AND METHOD FOR USING THE SAME

(71) Applicant: Northeastern University, Shenyang (CN)

(72) Inventors: Xiating Feng, Shenyang (CN); Feng Lin, Shenyang (CN); Chengxiang Yang, Shenyang (CN); Jiuyu Zhang, Shenyang (CN); Shiping Li, Shenyang (CN); Tianyang Tong, Shenyang (CN); Xiangxin Su, Shenyang (CN)

(73) Assignee: NORTHEASTERN UNIVERSITY, Shenyang (CN)

( * ) Notice: Subject to any disclaimer, the term of this patent is extended or adjusted under 35 U.S.C. 154(b) by 0 days.

(21) Appl. No.: 17/919,439

(22) PCT Filed: Nov. 18, 2021

(86) PCT No.: PCT/CN2021/131415

§ 371 (c)(1),
(2) Date: Oct. 17, 2022

(87) PCT Pub. No.: WO2023/070771

PCT Pub. Date: May 4, 2023

(65) Prior Publication Data

US 2023/0145203 A1 May 11, 2023

(30) Foreign Application Priority Data

Oct. 29, 2021 (CN) ..... 202111270967.8

(51) Int. Cl.
*E21D 9/10* (2006.01)
*H05B 6/80* (2006.01)

(52) U.S. Cl.
CPC ..... *E21D 9/1073* (2013.01); *H05B 6/80* (2013.01); *H05B 2206/044* (2013.01)

(58) Field of Classification Search
CPC .... E21D 9/1073; H05B 6/80; H05B 2206/044
See application file for complete search history.

(56) References Cited

U.S. PATENT DOCUMENTS 5,003,144 A 3/1991 Lindroth et al.
10,428,654 B2 * 10/2019 Feng ..... E21D 9/1073

FOREIGN PATENT DOCUMENTS

CN 101852444 A 10/2010
CN 104470184 A 3/2015
(Continued)

*Primary Examiner* — Janine M Kreck
(74) *Attorney, Agent, or Firm* — Muncy, Geissler, Olds & Lowe, P.C.

(57) ABSTRACT

The invention provides a microwave plasma adaptive rock breaking device for microwave-insensitive rocks and a using method thereof, and relates to the technical field of rock breaking. The microwave plasma adaptive rock breaking device comprises a microwave system, a microwave plasma conversion system and a cutter head system. The microwave system and the microwave plasma conversion system are mounted in the cutter head system, and the microwave system is connected with the microwave plasma conversion system. Under the premise that only a microwave source is used to supply energy, the combined action of ordinary microwave irradiation and plasma irradiation in the form of high-temperature flame is realized, and a full-section hard rock tunnel boring machine is in cooperation for breaking rocks, so that the problem of microwave-induced cracks of the microwave-insensitive rocks is solved, and the application scope of a microwave rock breaking technology is enlarged.

9 Claims, 5 Drawing Sheets

(56) References Cited

FOREIGN PATENT DOCUMENTS

| | | | |
|---|---|---|---|
| CN | 111101960 | A | 5/2020 |
| CN | 112983283 | A | 6/2021 |
| CN | 113107516 | A | 7/2021 |

* cited by examiner

MICROWAVE PLASMA ADAPTIVE ROCK BREAKING DEVICE FOR MICRO WAVE-INSENSITIVE ROCKS AND METHOD FOR USING THE SAME

BACKGROUND OF THE INVENTION

1. Field of the Invention

The invention relates to the technical field of rock breaking, in particular to a microwave plasma adaptive rock breaking device for microwave-insensitive rocks and a method for using the same.

2. The Prior Arts

Among the many rock breaking techniques, mechanical rock breaking and drill-and-blast methods are two most commonly-used construction methods. Compared with traditional drill-and-blast construction method, mechanical rock breaking has the advantages of fewer disturbances to surrounding rocks, high construction accuracy, and the like, and especially a full-section hard rock tunnel boring machine has been widely used in tunnel engineering. However, hard nature of the rock will lead to serious wear of cutters of the full-section hard rock tunnel boring machine tool, and the tunneling speed will be greatly reduced.

In the past half century, many novel auxiliary rock breaking techniques have been developed, such as laser rock breaking, high-pressure water jet rock breaking, electric blasting rock breaking, plasma rock breaking technique and microwave rock breaking technique, wherein the microwave rock breaking technique having the advantages of non-contact, volume heating and environmental protection becomes the rock breaking technique having the high application potential. The essence of the microwave rock breaking lies in that microwave-sensitive minerals in the rocks heat up after being irradiated by microwaves, and a thermal stress difference is generated between the microwave-sensitive minerals and microwave-insensitive minerals, which resulting in cracking even melting, thereby reducing the strength of the rock and increasing the tunneling speed.

The problem with microwave rock breaking technology is that it has no effect on microwave-insensitive minerals. In actual tunnel engineering, a rock mass structure and lithology change greatly, and there are a large number of microwave-insensitive rock sections, or rocks insensitive to microwaves at room temperature but sensitive to microwave at high temperature exist. Such rocks do not heat up under microwave irradiation, or heat up slowly, and cannot be fractured, which limits scope of application of microwave rock breaking techniques. Meanwhile, there is no material to absorb microwaves, and a large amount of microwave irradiation will cause damage to microwave equipment. Therefore, it is necessary to solve the problem of cracking of the microwave-insensitive rocks. A feasible method is to use other rock breaking methods to cooperate with a microwave technique, such as water jet cooperating with microwave rock breaking. When encountering microwave-insensitive rocks, only water jet rock breaking is used, and when encountering microwave-sensitive sections, microwave rock breaking is used, but the method will increase the complexity of the process flow and equipment structure.

Plasma rock breaking directly heats the rocks through the generated high-temperature plasma arc, and the rock mineral decomposition or thermal expansion reduces the strength of the rocks. The advantage of the plasma rock breaking is that it has a wide application range for rocks, and a microwave system can be used for the emission of the high-temperature plasma arc. The disadvantage of the plasma rock breaking is that it is not as efficient as microwave rock breaking when fracturing the microwave-sensitive rocks. Therefore, it is urgent to develop a rock breaking device and method with a simple structure, which integrates microwave and plasma rock breaking techniques, and realizes adaptive rock mass in situ, so as to solve the problem of cracking of microwave-insensitive rocks in hard rock tunnels.

SUMMARY OF THE INVENTION

The purpose of the present invention is to provide a microwave plasma adaptive rock breaking device for microwave-insensitive rocks and a method using the same, which can realize dynamic conversion and irradiation when the temperature of plasma torches of ordinary microwave/plasma reaches 3000-6500K for rocks with different microwave sensitivities under the premise of using a single microwave source to supply energy, and solves the problem of cracking of microwave-insensitive hard rocks.

In order to achieve the purpose, the invention adopts the following technical solutions:

A microwave plasma adaptive rock breaking device for microwave-insensitive rocks, comprising a microwave system, a microwave plasma conversion system and a cutter head system, wherein the microwave system and the microwave plasma conversion system are mounted in the cutter head system, and the microwave system is connected with the microwave plasma conversion system.

The cutter head system comprises a machine body, a cutter head, cutting heads and a support frame, wherein the cutter head is rotatably mounted at a front end of the machine body, multiple circles of the cutting heads are arranged at a front end of the cutter head from a center to an edge, and the cutting heads disposed on the same circle are arranged at equal intervals along a circumferential direction, the support frame is fixedly mounted in an inner cavity of the machine body, and the support frame is arranged near one end of the cutting heads.

The microwave system comprises a plurality of microwave power sources, a plurality of microwave generators, a rectangular waveguide I, a power divider I and a transmission gear I, wherein the microwave power sources and the microwave generators are mounted on a bottom plate of the inner cavity of the machine body of the cutter head system, each microwave power source is connected with the corresponding microwave generator, a water cooling device is mounted in a central hole of each microwave generator, a top end of each water cooling device extends to an outer side of the microwave generator, the water cooling devices are used for reducing a temperature of magnetrons, the microwave generators arranged in parallel are connected with one end of the rectangular waveguide I after being collected through a transfer pipe, the other end of the rectangular waveguide I and one end of a rotary waveguide I are rotatably mounted through a bearing, an automatic matching tuner is mounted at one end close to the microwave generators, on an upper surface of the rectangular waveguide I, a function of the automatic matching tuner lies in that the automatic matching tuner automatically adjusts reflection when encountering conditions of the rock of other sudden changes including containing water, so as to prevent the magnetrons from being damaged due to excessive reflection, a power reflectometer is mounted at one end close the rotary waveguide I, the rotary waveguide I penetrates through an inner hole of the support frame and the rotary waveguide I and the support frame are connected by the bearing, the transmission gear I is mounted on an outer wall of the rotary waveguide I through a gear ferrule I, a drive motor I is fixedly mounted on a side wall of the support frame through bolts, an output shaft of the drive motor I and the support frame are mounted in a transmission manner through the bearing, and the drive motor I is disposed below the rotary waveguide, a tail end of the output shaft of the drive motor I extends to an outside of the support frame and is in key connection with a transmission gear II, the transmission gear II is meshed with the transmission gear I, the other end of the rotary waveguide I is connected with one end of a rectangular waveguide II, a high-precision sliding ring sleeves an outer side of the rectangular waveguide II, the other end of the rectangular waveguide II penetrates through the cutter head to be connected with one end of the power divider I located in the inner cavity of the cutter head, the rectangular waveguide II and the cutter head are rotatably mounted through the bearing, and the function of the high-precision sliding ring lies in that reflection signals of a plurality of output ends on the power divider I capable of rotatably moving can be converted to fixed cables, to be transmitted to the power reflectometer so as to be displayed; and right-angle transmission waveguides are arranged on outer circle surface and front end surface of the power divider I at equal intervals along the circumferential direction, and the transmission waveguides are arranged in a center of the front end surface of the power divider I, drive motors II are mounted at vertical parts of the right-angle transmission waveguides, transmission gears III are respectively in key connection to the tail ends of the output shafts of the drive motors II, the tail ends of horizontal parts of the right-angle transmission waveguides and rear end of the rotary waveguides II are rotatably mounted through the bearing, and transmission gears IV meshed with the transmission gears III are mounted on outer sides of the rotary waveguides II through gear ferrules II.

The microwave plasma conversion system comprises a plurality of microwave conversion switches, the microwave conversion switches are respectively connected with front ends of the corresponding rotary waveguides II and front ends of the transmission waveguides, microwave plasma applicators and ordinary microwave applicators are respectively mounted at the other ends of the microwave conversion switches, the cutting heads in one-to-one correspondence with the right-angle transmission waveguides and the transmission waveguides are arranged at the front end of the cutter head, the power divider I is divided into nine output ends which are in one-to-one correspondence with the microwave plasma applicators and the ordinary microwave applicators, and they are distributed on the trajectories of two concentric circles with different diameters and the positions of circle centers are consistent with the distribution on the trajectories of the cutting heads, wherein the number is sequentially: one concentric circle, and the diameters of the concentric circles are sequentially three and five from small to large.

The ordinary microwave applicator comprises a microwave heater, a mica plate baffle and a quartz sleeve, wherein the rear ends of the microwave heaters are connected with the microwave conversion switches through waveguide tubes, the mica plate baffle is arranged at a front end of the corresponding microwave heater, the mica plate baffle and the corresponding microwave heater are mounted in the corresponding quartz sleeve together, the quartz sleeve is fixedly mounted on the waveguide tube of the corresponding microwave heater, the quartz sleeve is arranged to prevent detritus from collapsing to the corresponding waveguide tube to achieve the effect of protecting the magnetron, and the front ends of the microwave heaters are located in through holes in a front end surface of the cutter head and are flushed with the front end surface of the cutter head.

The microwave plasma applicator comprises a power divider, a narrow-side waveguide and a quartz tube, wherein a rear end of the power divider is connected with the corresponding microwave conversion switch through the corresponding waveguide tube, the narrow-side waveguides are respectively mounted at a front end of the power divider, the quartz tubes are fixedly mounted in the through holes in vertical parts of the narrow-side waveguides, air inlets are formed in rear ends of the quartz tubes, plasma torches are respectively mounted in the quartz tubes, and the plasma torches are ejected out from the front ports of the quartz tubes.

The raised height of each cutting head is ¼-½ microwave wavelength. Infrared thermal imagers are respectively arranged at middle positions of each cutting heads on the front end surface of the cutter head and the corresponding plasma torch so as to monitor a temperature of the rocks and photograph the surface morphology of the rocks.

The microwave plasma applicators are arranged in a straight line, and the length of the arrangement is equal to that of the microwave heaters.

A method for using the microwave plasma adaptive rock breaking device for microwave-insensitive rocks comprises the following steps:

Step 1: through a control panel of a full-section hard rock tunnel boring machine, switching on the cutter head for tunneling, and according to the performance of the full-section hard rock tunnel boring machine, setting rotating speed and propulsion force of the cutter head to the maximum value for safe work through the control panel, that is, the rotating speed is $V_1$, and the propulsion force is N; performing field measurement to obtain propulsion speed $V_2$ without switching on the microwave system, and starting the drive motor I to switch on the rotary waveguide I, wherein the rotating speed of the rotary waveguide I is the same as the angular velocity of the cutter head;

Step 2: switching on any microwave generator, adjusting the microwave conversion switches, closing the input port of the microwave plasma applicator on the microwave conversion switch, opening the input port of the microwave heater on each ordinary microwave applicators, and switching on all microwave heaters, wherein because each microwave generator is divided into a plurality of microwave heaters to output microwaves, reflections generated by each microwave heater are accumulated to achieve the switched-on microwave generator, during the process of detecting the matching performance of the rocks, a sum of the output powers of the microwave heaters is PkW, the output power of the single microwave heater is 1-3 kW, if the number of the microwave heaters is k, then P=(1-3)k, the microwave generators are not damaged when the output power is fully emitted, reflection coefficients are monitored through the output of the microwave generators, the lower limit of the reflection coefficients is set as a, the upper limit on the reflection coefficients is set as b, the lower limit a and the upper limit b of the reflection coefficients can be obtained through laboratory experiment, wherein the lower limit a of the reflection coefficients represents reflection coefficients corresponding to microwave-insensitive rocks, and the upper limit b of the reflection coefficients represents maximum reflection coefficients which can be borne by the microwave generators;

(1) when the reflection coefficients are in a safe range between the lower limit a of the reflection coefficients and the upper limit b of the reflection coefficients, gradually increasing the microwave power of the microwave generators to a full power state, wherein if the microwave power reaches the maximum power, the reflection coefficients are still between the lower limit a and the upper limit b of the reflection coefficients, the microwave generators continue to work with the microwave power parameters at this time; if the reflection coefficients exceed the safe range between the lower limit a and the upper limit b of the reflection coefficient in the process of gradually increasing the microwave power, and the microwave power has not yet reached the maximum power, adjusting the microwave conversion switches, opening the input ports of the microwave plasma applicators to heat the rocks, and distributing the remaining microwave power to the microwave plasma applicators for output;

(2) when the reflection coefficients are less than the lower limit a of the reflection coefficients, keeping the single-port microwave output power PkW, while adjusting the microwave conversion switches, opening the input ports of the microwave plasma applicators to heat the rocks, wherein the power of the single plasma torch is ¼PkW; observing whether the reflection coefficients increase or not, if it increases to the safe range between the lower limit a of the reflection coefficients and the upper limit b of the reflection coefficients, it indicates that high temperature of the plasma torches increases the microwave sensitivity of the rocks, then continues to increase the single-port microwave power of the microwave heaters, when the maximum power is achieved, the reflection coefficients are still in the safe range between the lower limit a and the upper limit b of the reflection coefficients, the microwave generators continue to work with the microwaves parameters at this time; when the reflection coefficients exceed the safe range between the lower limit a and the upper limit b of the reflection coefficient during the heating process of the rocks, and when the power of the microwave system has not yet reached the maximum power, the residual power is distributed and output through the microwave plasma applicators;

(3) when the reflection coefficients are greater than the upper limit b of the reflection coefficients, adjusting the microwave conversion switches, opening the input ends of the microwave plasma applicators, applying power to the input ports of the microwave plasma applicators, and performing outputting through the microwave plasma applicators;

Step 3: after the microwave power parameters are determined, the rotating speed of the cutter head is $V_1$, and the propulsion force is N, according to the field measurement results, obtaining the propulsion speed $V_3$ when the microwave system is switched on, and if $V_3>V_2$, continuing the tunneling work; if $V_3=V_2$, and an output mode is ordinary microwave, switching to the output of all the plasma applicators, and continuing the tunneling work; if $V_3<V_2$, setting the propulsion force to 0, stopping propulsion and switching on the microwave system, repeating Steps 1 to 2, when the surfaces of the rocks crack, switching off the microwave system, setting the propulsion force to N to start propulsion, wherein the propulsion distance is 5-8 times of the penetration depth of the rocks, setting the propulsion force to 0 again to stop propulsion, switching on the microwave system, when the surfaces of the rocks crack, switching off the microwave system, and repeating the process of microwave irradiation-propulsion to perform the tunneling work; and Step 4: setting the rotary waveguides II to rotate at different rotating speeds, repeating the Steps 1 to 3, comparing the increase of the propulsion speed $V_3$ compared to the propulsion speed $V_2$, and determining the optimal rotating speed of the rotary waveguides II.

The method adopting the technical scheme has the beneficial effects:

(1) Under the premise that only a microwave source is used to supply energy, the combined action of ordinary microwave irradiation and plasma irradiation in the form of high-temperature flame is realized, and the full-section hard rock tunnel boring machine is in cooperation for breaking rocks, so that the problem of microwave-induced cracks of the microwave-insensitive rocks is solved, and the application scope of the microwave rock breaking technology is enlarged.

(2) The rotary waveguide is used to realize rotation of microwave energy and the plasma output end on the cutter head, the microwave conversion switch is used to realize the free conversion of the microwave energy in the form of the ordinary microwaves and the plasmas is realized, and on the premise of ensuring the simple and portable structure of the device, the combined effect of microwaves and the full-section hard rock tunnel boring machine is realized.

(3) A method of plasma torch heating rocks at high temperature and ordinary microwaves irradiation is used to solve the problem of microwave-induced cracks of the rocks which are insensitive to constant-temperature microwaves but sensitive to high-temperature microwaves.

(4) By monitoring reflection coefficients to feedback microwave sensitivity of the rocks in an irradiated area, switching on and off the ordinary microwaves and the plasmas can be dynamically controlled based on the reflection coefficients.

In drawings, 1: machine body; 2: microwave power source; 3: microwave generator; 4: water cooling device; 5: automatic matching tuner; 6: rectangular waveguide I; 7: rotary waveguide I; 8: power reflectometer; 9: drive motor I; 10: support frame; 11: transmission gear I; 12: transmission gear II; 13: high-precision sliding ring; 14: rectangular waveguide II; 15: cutter head; 16: right-angle transmission waveguide; 17: power divider; 18: rotary waveguide II; 19: drive motor II; 20: transmission gear III; 21: transmission gear IV; 22: cutting head; 23: microwave plasma applicator; 24: ordinary microwave applicator; 25: microwave conversion switch; 26: power divider II; 27: plasma torch; 28: microwave heater; 29: air inlet; 30: quartz tube; 31: narrow-side waveguide; 32: mica plate baffle; and 33: quartz sleeve.

DETAILED DESCRIPTION OF THE PREFERRED EMBODIMENT

The invention will be further described in detail below in conjunction with the accompanying drawings and embodiments.

Figure 1:
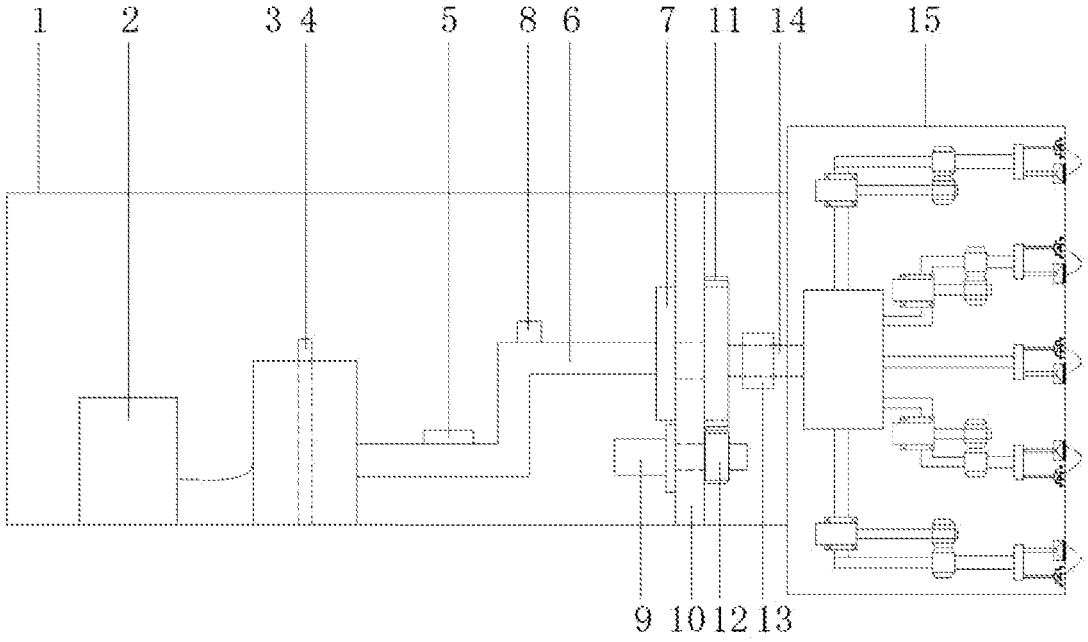
FIG. 1 is a schematic diagram of an overall structure of a microwave plasma adaptive rock breaking device for microwave-insensitive rocks according to the invention.
Figure 2:
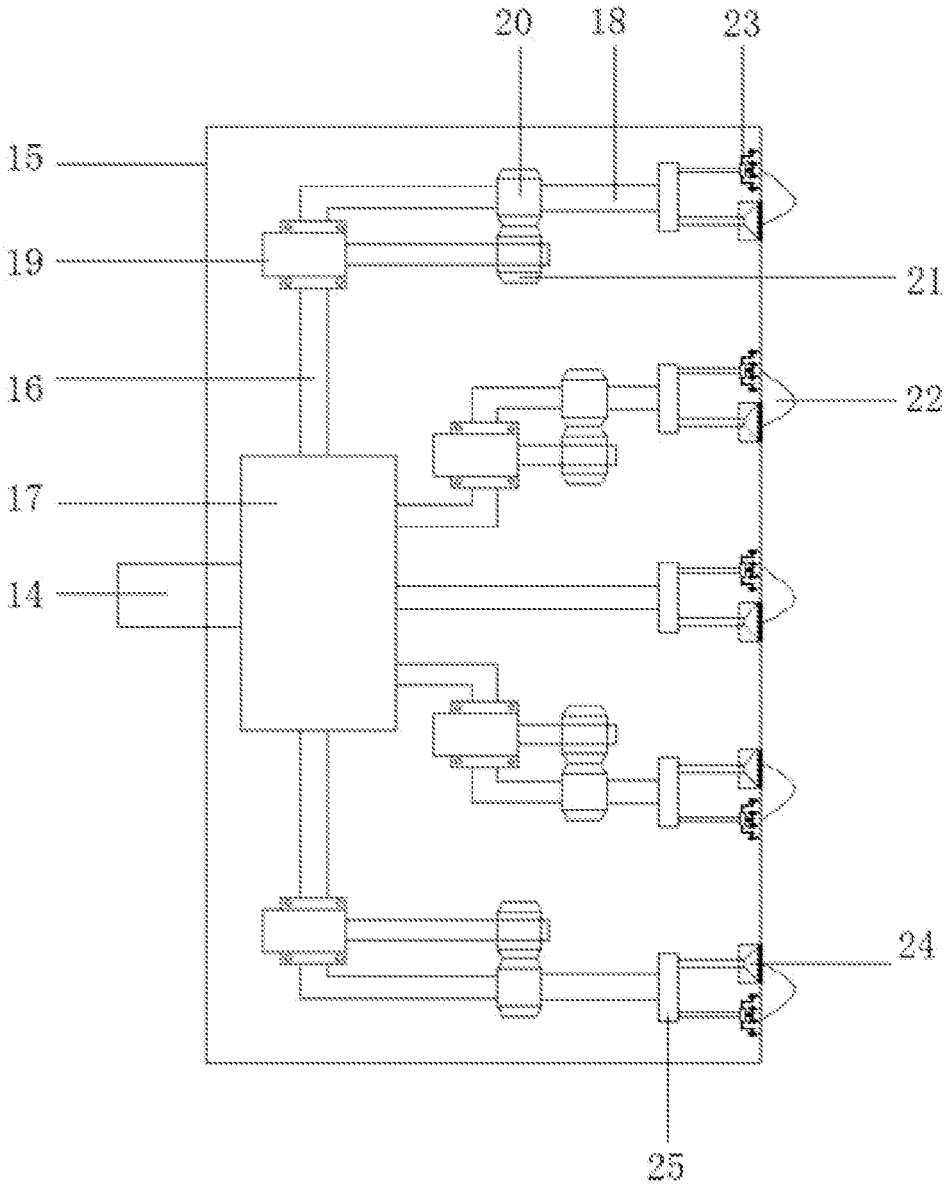
FIG. 2 is a schematic diagram of an internal structure of a cutter head of the microwave plasma adaptive rock breaking device for microwave-insensitive rocks according to the invention.
Figure 3:
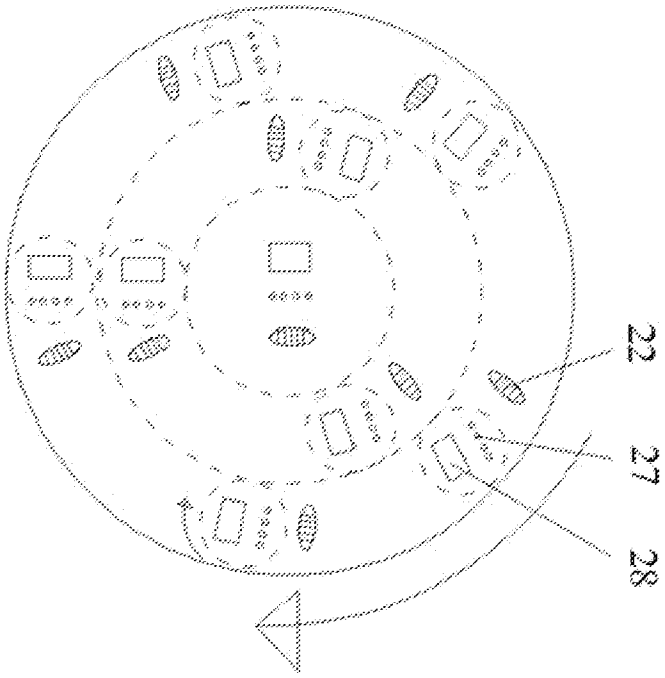
FIG. 3 is a side view of a cutter head of the microwave plasma adaptive rock breaking device for microwave-insensitive rocks according to the invention.
Figure 4:
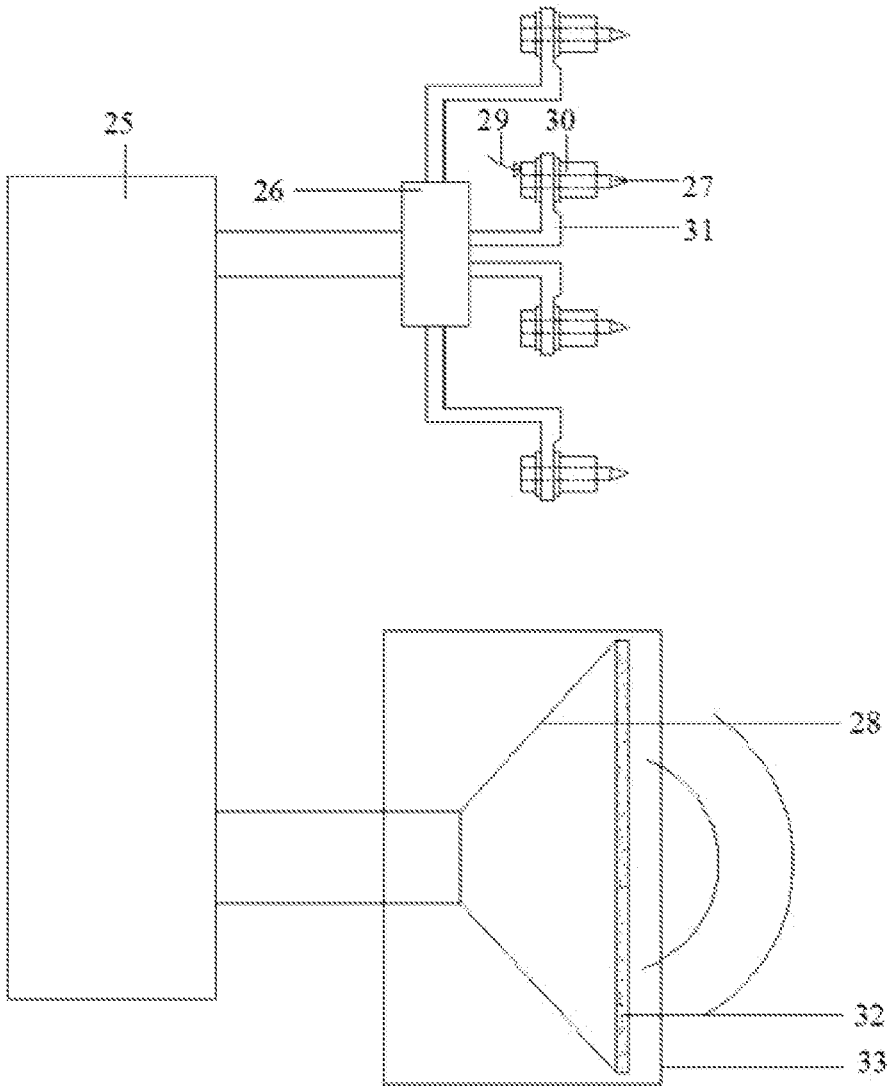
FIG. 4 is a schematic structural diagram of a microwave plasma conversion system of the microwave plasma adaptive rock breaking device for microwave-insensitive rocks according to the invention.
Figure 5:
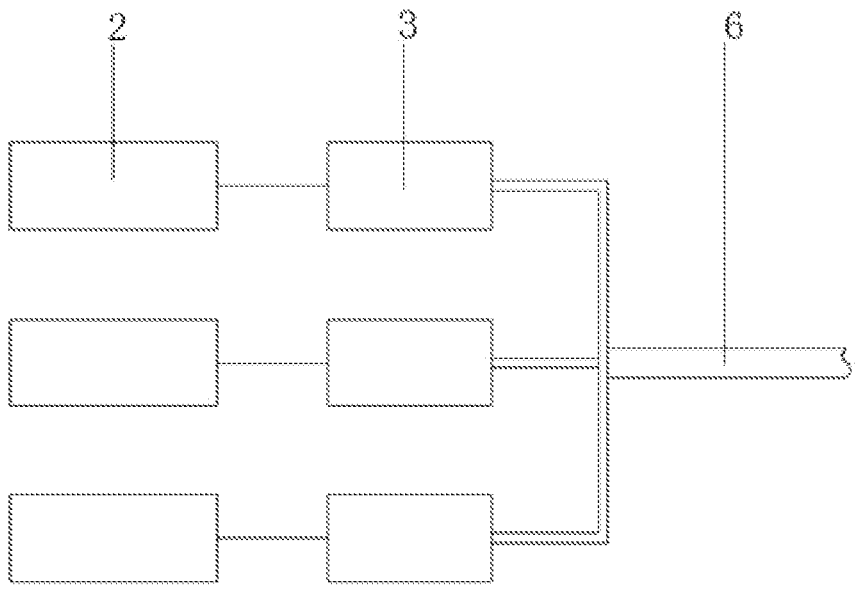
FIG. 5 is a schematic diagram of connection between a plurality of microwave power sources and microwave generators of the microwave plasma adaptive rock breaking device for microwave-insensitive rocks according to the invention.

As shown in FIGS. 1 to 5, the microwave plasma adaptive rock breaking device for microwave-insensitive rocks comprises a microwave system, a microwave plasma conversion system and a cutter head system, wherein the microwave system and the microwave plasma conversion system are mounted in the cutter head system, and the microwave system is connected with the microwave plasma conversion system.

The cutter head system comprises a machine body 1, a cutter head 15, cutting heads 22 and a support frame 10, wherein the cutter head 15 is rotatably mounted at the front end of the machine body 1, the front end of the cutter head 15 is provided with multiple circles of cutting heads 22 from the center to the edge, and the cutter heads 22 located on the same circle are arranged at an equal intervals along the circumference, the support frame 10 is fixedly mounted in the inner cavity of the machine body 1, and the support frame 10 is arranged close to one ends of the cutting heads 22.

The microwave system comprises a plurality of microwave power sources 2, a plurality of microwave generators 3, a rectangular waveguide I 6, a power divider I 17 and a transmission gear I 11, wherein the microwave power sources 2 and the microwave generators 3 are mounted on a bottom plate of the inner cavity of the machine body 1 of the cutter head system, each microwave power source 2 is connected with the corresponding microwave generator 3, a water cooling device 4 is mounted in the central hole of each microwave generator 3, a top end of the water cooling device 4 extends to the outer side of the corresponding microwave generator 3, the water cooling device 4 is a circulating water pipeline, water enters from one end and exits from the other end, and the circulating water pipeline is arranged close to the surface of the magnetron of the microwave generator 3, the water cooling devices 4 are used for reducing the temperature of magnetrons, the microwave generators 3 arranged in parallel are collected through a transfer pipe and then connected with one end of the rectangular waveguide I 6, the maximum power provided by each microwave generator 3 is 100 kW, the microwave frequency is 915 Mhz, the other end of the rectangular waveguide I 6 and one end of a rotary waveguide I 7 are rotatably mounted through a bearing, an automatic matching tuner 5 is mounted at one end close to the microwave generators 3 on the upper surface of the rectangular waveguide I 6, the function of the automatic matching tuner 5 lies in that it automatically adjusts reflection when encountering rock conditions of other sudden changes including containing water, so as to prevent the magnetrons from being damaged due to excessive reflection, a power reflectometer 8 is mounted near the end of the rotary waveguide I 7, and the rotary waveguide I 7 penetrates through an inner hole of the support frame 10, and is connected with each other through the bearing, the transmission gear I 11 is mounted on the outer wall of the rotary waveguide I 7 through a gear ferrule I, a drive motor I 9 is fixedly mounted on the side wall of the support frame 10 through bolts, an output shaft of the drive motor I 9 is transmitted and installed through the bearing and the support frame 10, and the drive motor I 9 is arranged below the rotary waveguide, the tail end of the output shaft of the drive motor I 9 extends to the outside of the support frame 10 and is connection with a transmission gear II 12 through a key, and the transmission gear II 12 is meshed with the transmission gear I 11, the other end of the rotary waveguide I 7 is connected with one end of a rectangular waveguide II 14, the outer side of the rectangular waveguide II 14 is sheathed with a high-precision sliding ring 13, and the other end of the rectangular waveguide II 14 penetrates through the cutter head 15 to be connected with one end of the power divider I 17 located in the inner cavity of the cutter head 15, the rectangular waveguide II 14 and the cutter head 15 are rotatably mounted through the bearing, and the function of the high-precision sliding ring 13 is to convert the reflection signals from a plurality of output ends of the power divider I 17 to fixed cables so as to transmit them to the power reflectometer for display; and right-angle transmission waveguides 16 are arranged at equal intervals along the circumferential direction on the outer circle surface and the front end surface of the power divider I 17, and the transmission waveguides are arranged in the center of the front end surface of the power divider I 17, the vertical part of the right-angle transmission waveguide 16 is sheathed with a fixed sleeve fixedly mounted with the right-angle transmission waveguide 16, and a square plate with a hole is welded on the outside of the fixing sleeve, the drive motor II 19 is fixedly mounted on the square plate with a hole through the bolts, the tail ends of the output shafts of the drive motors II 19 is connected with a transmission gears III 20 through a key, the tail ends of the horizontal parts of the right-angle transmission waveguides 16 is rotatably mounted with the rear end of the rotary waveguides II 18 through the bearing, and transmission gears IV 21 meshed with the transmission gears III 20 are mounted on the outer sides of the rotary waveguides II 18 through gear ferrules II.

The microwave plasma conversion system comprises a plurality of microwave conversion switches 25, wherein the microwave conversion switches 25 are respectively connected with the front ends of the corresponding rotary waveguides II 18 and the front ends of the transmission waveguides, microwave plasma applicators 23 and ordinary microwave applicators 24 are respectively mounted at the other ends of the microwave conversion switches 25, the microwave plasma applicators 23 and the ordinary microwave applicators 24 as well as the cutting heads 22 are in correspondence arrangement, the power divider I 17 is divided into nine output ends, which correspond to the microwave plasma applicators 23 and the ordinary microwave applicators 24 one by one, and are distributed on the trajectories of two concentric circles with different diameters and the position of circle center is consistent with the distribution rules of the cutting heads, wherein the number is sequentially: one circle center, and the diameters of the concentric circles are sequentially three and five from small to large.

The ordinary microwave applicator 24 comprises a microwave heater 28, a mica plate baffle 32 and a quartz sleeve 33, wherein the rear ends of the microwave heaters 28 are connected with the microwave conversion switches 25 through waveguide tubes, the mica plate baffle 32 is arranged at the front end of the corresponding microwave heater 28, and the mica plate baffle 32 and the corresponding microwave heater 28 are mounted in the corresponding quartz sleeve 33 together, the quartz sleeve 33 is fixedly mounted on the waveguide tube of the corresponding microwave heater 28, the quartz sleeve 33 is arranged to prevent the rock debris from collapsing to the waveguide tube to achieve the effect of protecting the magnetron, and the front ends of the microwave heaters 28 are located in through holes in the front end surface of the cutter head 15 and are flushed with the front end surface of the cutter head 15.

The microwave plasma applicator 23 comprises a power divider II 26, a narrow-side waveguide 31 and a quartz tube 30, wherein the rear end of the power divider II 26 is connected with the microwave conversion switch 25 through the waveguide tube, the front end and the outer circle of the power divider II 26 are respectively provided with the narrow-side waveguide 31, the quartz tubes 30 are fixedly mounted in the through holes in the vertical parts of the narrow-side waveguide 31, the rear ends of the quartz tubes 30 is provided with an air inlets 29, plasma torches 27 are respectively mounted in the quartz tubes 30, and plasma torches are ejected out from the front ports of the quartz tubes 30.

The raised height of the cutting head 22 is ¼-½ wavelength. Infrared thermal imagers are respectively arranged at the middle positions of each cutting head 22 on the front end surface of the cutter head 15 and the corresponding plasma torch 27 for monitoring the temperature of the rocks and photograph the surface morphology of the rocks.

A plurality of microwave plasma applicators 23 are arranged in a straight line, and the length of the arrangement is equal to that of the microwave heaters 28.

A method for using the microwave plasma adaptive rock breaking device for microwave-insensitive rocks comprises the following steps:

Step 1: through a control panel of a full-section hard rock tunnel boring machine, switching on the cutter head 15 for tunneling, according to the performance of the full-section hard rock tunnel boring machine, setting rotating speed and propulsion force of the cutter head 15 to the maximum value for safe work through the control panel, that is, the rotating speed of the cutter head 15 is $V_1$ and the propulsion force is N; performing field measurement to obtain propulsion speed $V_2$ without switching on the microwave system, and starting the drive motor I 9 to switching on the rotary waveguide I 7, wherein the rotating speed of the rotary waveguide I 7 is the same as the angular velocity of the cutter head 15;

Step 2: switching on any microwave generator 3, adjusting the microwave conversion switches 25, closing the input port of the microwave plasma applicator 23 on each microwave conversion switch 25, opening the input port of the microwave heater 28 on the ordinary microwave applicator 24, and switching on all microwave heaters 28, wherein because each microwave generator 3 is divided into a plurality of microwave heaters 28 to output microwaves, the accumulated reflections generated by each microwave heater 28 will reach the microwave generator 3 that is switched on, in the process of detecting the matching performance of the rocks, the sum of the output powers of the microwave heaters 28 is PkW, the output power of the single microwave heater 28 is 1-3 kW, the number of the microwave heaters 28 is k, P=(1-3)k, the microwave generators 3 are not damaged when the output power is fully emitted, reflection coefficients are monitored through the output of the microwave generators 3, the lower limit of the reflection coefficients is set as a, the upper limit on the reflection coefficients is set as b, the lower limit a and the upper limit b of the reflection coefficients can be obtained through laboratory experiment, wherein the lower limit a of the reflection coefficients represents reflection coefficients corresponding to microwave-insensitive rocks, and the upper limit b of the reflection coefficients represents maximum reflection coefficients which can be borne by the microwave generators 3;

(1) when the reflection coefficients are in a safe range between the lower limit a of the reflection coefficients and the upper limit b of the reflection coefficients, gradually increasing the microwave power of the microwave generators 3 to a full power state, wherein if the microwave power reaches the maximum power, the reflection coefficients are still between the lower limit a and the upper limit b of the reflection coefficients, the microwave generators 3 continue to work with the microwave power parameters at this time, if the reflection coefficients exceed the safe range between the lower limit a and the upper limit b of the reflection coefficient in the process of gradually increasing the microwave power, and the microwave power has not yet reached the maximum power, then adjusting the microwave conversion switches 25, opening the input ports of the microwave plasma applicators 23 to heat the rocks, and distributing the remaining microwave power to the microwave plasma applicators 23 for output;

(2) when the reflection coefficients are less than the lower limit a of the reflection coefficients, keeping the single-port microwave output power PkW, while adjusting the microwave conversion switches 25, opening the input ports of the microwave plasma applicators 23 to heat the rocks, wherein the power of the single plasma torch 27 is ¼PkW; observing whether the reflection coefficients increase or not, wherein if the reflection coefficients increase to the safe range between the lower limit a and the upper limit b of the reflection coefficients, it indicates that high temperature of the plasma torches 27 increases the microwave sensitivity of the rocks, so the single-port microwave power of the microwave heaters 28 continues to increase, when the maximum power is achieved, the reflection coefficients are still in the safe range between the lower limit a and the upper limit b of the reflection coefficients, the microwave generators 3 continue to work with the microwaves at this time; if the reflection coefficients exceed the safe range between the lower limit a and the upper limit b of the reflection coefficient in the process of increasing the temperature of the rocks, and when the power of the microwave system has not yet reached the maximum power, distributing the remaining power to pass through the microwave plasma applicators 23 for output;

(3) when the reflection coefficients are greater than the upper limit b of the reflection coefficients, adjusting the microwave conversion switches 25, opening the input ends of the microwave plasma applicators 23, applying power to the input ports of the microwave plasma applicators 23, and performing outputting through the microwave plasma applicators 23;

Step 3: determining microwave power parameters, wherein the rotating speed of the cutter head 15 is $V_1$, and the propulsion force is N, according to the field measurement results, obtaining the propulsion speed $V_3$ when the microwave system is switched on, and if $V_3>V_2$, continuing the tunneling work; if $V_3=V_2$, and an output mode is ordinary microwave, performing switching to the output of all of the plasma applicators, and continuing the tunneling work; if $V_3<V_2$, setting the propulsion force to 0, stopping propulsion, switching on the microwave system, repeating Steps 1 to 2, when the surfaces of the rocks crack, switching off the microwave system, setting the propulsion force to N to start propulsion, wherein the propulsion distance is 5-8 times of the penetration depth of the rocks, setting the propulsion force to 0 again to stop propulsion, switching on the microwave system, when the surfaces of the rocks crack, switching off the microwave system, and repeating the process of microwave irradiation-propulsion to perform the tunneling work; and Step 4: setting the rotary waveguides II 18 to rotate at different rotating speeds, when the rotating speed is 0, repeating the Steps 1 to 3, comparing the propulsion speed $V_3$ with the propulsion speed $V_2$ to obtain the increasing range of the propulsion speed $V_3$, and determining the optimal rotating speed of the rotary waveguides II 18.

What is claimed is:

1. A method for using a microwave plasma adaptive rock breaking device for microwave-insensitive rocks, the microwave plasma adaptive rock breaking device comprising a microwave system, a microwave plasma conversion system and a cutter head system, wherein the microwave system and the microwave plasma conversion system are mounted in the cutter head system, and the microwave system is connected with the microwave plasma conversion system, the method comprising the following steps:

Step 1: through a control panel of a full-section hard rock tunnel boring machine, switching on a cutter head for tunneling, and according to the performance of the full-section hard rock tunnel boring machine, setting rotating speed and propulsion force of the cutter head to the maximum value for safe work through the control panel, that is, the rotating speed is $V_1$, and the propulsion force is N; performing field measurement to obtain propulsion speed $V_2$ without switching on the microwave system, and starting a drive motor I to switch on a rotary waveguide I, wherein the rotating speed of the rotary waveguide I is the same as the angular velocity of the cutter head;

Step 2: switching on any microwave generator, adjusting the microwave conversion switches, closing an input port of a microwave plasma applicator on the microwave conversion switches, opening the input port of a microwave heater on each ordinary microwave applicators, and switching on all microwave heaters, wherein because each microwave generator is divided into a plurality of microwave heaters to output microwaves, reflections generated by each microwave heater are accumulated to achieve the switched-on microwave generator, a sum of the output powers of the microwave heaters is PkW, the output power of a single microwave heater is 1-3 kW, if the number of the microwave heaters is k, then P=(1-3)k, the microwave generators are not damaged when the output power is fully emitted, reflection coefficients are monitored through the output of the microwave generators, the lower limit of the reflection coefficients is set as a, the upper limit on the reflection coefficients is set as b, the lower limit a and the upper limit b of the reflection coefficients can be obtained through laboratory experiment, wherein the lower limit a of the reflection coefficients represents reflection coefficients corresponding to microwave-insensitive rocks, and the upper limit b of the reflection coefficients represents maximum reflection coefficients which can be borne by the microwave generators, wherein (1) when the reflection coefficients are in a safe range between the lower limit a of the reflection coefficients and the upper limit b of the reflection coefficients, gradually increasing the microwave power of the microwave generators to a full power state, wherein if the microwave power reaches the maximum power, the reflection coefficients are still between the lower limit a and the upper limit b of the reflection coefficients, the microwave generators continue to work with microwave power parameters at this time; if the reflection coefficients exceed the safe range between the lower limit a and the upper limit b of the reflection coefficient in the process of gradually increasing the microwave power, and the microwave power has not yet reached the maximum power, adjusting the microwave conversion switches, opening the input ports of the microwave plasma applicators to heat the rocks, and distributing the remaining microwave power to the microwave plasma applicators for output, (2) when the reflection coefficients are less than the lower limit a of the reflection coefficients, keeping a single-port microwave output power PkW, while adjusting the microwave conversion switches, opening the input ports of the microwave plasma applicators to heat the rocks, wherein the power of a single plasma torch is ¼PkW; observing whether the reflection coefficients increase or not, if it increases to the safe range between the lower limit a of the reflection coefficients and the upper limit b of the reflection coefficients, it indicates that a high temperature of the plasma torches increases the microwave sensitivity of the rocks, then continues to increase the single-port microwave power of the microwave heaters, when the maximum power is achieved, the reflection coefficients are still in the safe range between the lower limit a and the upper limit b of the reflection coefficients, the microwave generators continue to work with the microwaves parameters at this time; when the reflection coefficients exceed the safe range between the lower limit a and the upper limit b of the reflection coefficient during the heating process of the rocks, and when the power of the microwave system has not yet reached the maximum power, the residual power is distributed and output through the microwave plasma applicators, (3) when the reflection coefficients are greater than the upper limit b of the reflection coefficients, adjusting the microwave conversion switches, opening input ends of the microwave plasma applicators, applying power to the input ports of the microwave plasma applicators, and performing outputting through the microwave plasma applicators;

Step 3: after the microwave power parameters are determined, the rotating speed of the cutter head is $V_1$, and the propulsion force is N, according to the field measurement results, obtaining the propulsion speed $V_3$ when the microwave system is switched on, and if $V_3>V_2$, continuing the tunneling work; if $V_3=V_2$, and an output mode is ordinary microwave, switching to the output of all of the plasma applicators, and continuing the tunneling work; if $V_3<V_2$, setting the propulsion force to 0, stopping propulsion, and switching on the microwave system, repeating Steps 1 to 2, when the surfaces of the rocks crack, switching off the microwave system, setting the propulsion force to N to start propulsion, wherein the propulsion distance is 5-8 times of a penetration depth of the rocks, setting the propulsion force to 0 again to stop propulsion, switching on the microwave system, when the surfaces of the rocks crack, switching off the microwave system, and repeating the process of microwave irradiation-propulsion in the case of V3<V2 in step 3 to perform the tunneling work; and Step 4: setting a rotary waveguides II to rotate at different rotating speeds, repeating the Steps 1 to 3, comparing the increase of the propulsion speed $V_3$ compared to the propulsion speed $V_2$, and determining the optimal rotating speed of the rotary waveguides II.

2. The method of claim 1, wherein the cutter head system comprises a machine body, a cutter head, cutting heads and a support frame, the cutter head is rotatably mounted at a front end of the machine body, multiple circles of the cutting heads are arranged at a front end of the cutter head from a center to an edge, and the cutting heads disposed on the same circle are arranged at equal intervals along a circumferential direction, the support frame is fixedly mounted in an inner cavity of the machine body, and the support frame is arranged near one end of the cutting heads.

3. The method of claim 2, wherein the raised height of the cutting head is ¼-½ microwave wavelength.

4. The method claim 1, wherein the microwave system comprises a plurality of microwave power sources, a plurality of microwave generators, a rectangular waveguide I, a power divider I and a transmission gear I, the microwave power sources and the microwave generators are mounted on a bottom plate of an inner cavity of the machine body of the cutter head system, each microwave power source is connected with the corresponding microwave generator, a water cooling device is mounted in a central hole of each microwave generator, a top end of each water cooling device extends to an outer side of the microwave generator, the water cooling devices are used for reducing a temperature of magnetrons, the microwave generators arranged in parallel are connected with one end of the rectangular waveguide I after being collected through a transfer pipe, the other end of the rectangular waveguide I and one end of the rotary waveguide I are rotatably mounted through a bearing, an automatic matching tuner is mounted at one end close to the microwave generators, on an upper surface of the rectangular waveguide I, a function of the automatic matching tuner lies in that the automatic matching tuner automatically adjusts reflection when encountering conditions of the rock of other sudden changes including containing water, so as to prevent the magnetrons from being damaged due to excessive reflection, a power reflectometer is mounted at one end close the rotary waveguide I, the rotary waveguide I penetrates through an inner hole of the support frame and the rotary waveguide I and the support frame are connected by the bearing, the transmission gear I is mounted on an outer wall of the rotary waveguide I through a gear ferrule I, the drive motor I is fixedly mounted on a side wall of the support frame through bolts, an output shaft of the drive motor I and the support frame are mounted in a transmission manner through the bearing, and the drive motor I is disposed below the rotary waveguide, a tail end of the output shaft of the drive motor I extends to an outside of the support frame and is in key connection with a transmission gear II, the transmission gear II is meshed with the transmission gear I, the other end of the rotary waveguide I is connected with one end of a rectangular waveguide II, a sliding ring sleeves an outer side of the rectangular waveguide II, the other end of the rectangular waveguide II penetrates through the cutter head to be connected with one end of the power divider I located in an inner cavity of the cutter head, the rectangular waveguide II and the cutter head are rotatably mounted through the bearing, and a function of the sliding ring lies in that reflection signals of a plurality of output ends on the power divider I capable of rotatably moving can be converted to fixed cables, to be transmitted to the power reflectometer so as to be displayed; and right-angle transmission waveguides are arranged on outer circle surface and front end surface of the power divider I at equal intervals along a circumferential direction, and the transmission waveguides are arranged in a center of the front end surface of the power divider I, drive motors II are mounted at vertical parts of the right-angle transmission waveguides, transmission gears III are respectively in key connection to the tail ends of the output shafts of the drive motors II, tail ends of horizontal parts of the right-angle transmission waveguides and a rear end of the rotary waveguides II are rotatably mounted through the bearing, and transmission gears IV meshed with the transmission gears III are mounted on outer sides of the rotary waveguides II through gear ferrules II.

5. The method of claim 4, wherein the microwave plasma conversion system comprises a plurality of microwave conversion switches, the microwave conversion switches are respectively connected with front ends of the corresponding rotary waveguides II and front ends of the transmission waveguides, the microwave plasma applicators and the ordinary microwave applicators are respectively mounted at the other ends of the microwave conversion switches, the cutting heads in one-to-one correspondence with the right-angle transmission waveguides and the transmission waveguides are arranged at the front end of the cutter head, the power divider I is divided into nine output ends which are in one-to-one correspondence with the microwave plasma applicators and the ordinary microwave applicators, and are distributed on the trajectories of two concentric circles with different diameters and the positions of circle centers are consistent with the distribution on the trajectories of the cutting heads.

6. The method of claim 5, wherein rear ends of the microwave heaters are connected with the microwave conversion switches through waveguide tubes, a mica plate baffle is arranged at a front end of the corresponding microwave heater, the mica plate baffle and the corresponding microwave heater are mounted in a corresponding quartz sleeve together, the quartz sleeve is fixedly mounted on the waveguide tube of the corresponding microwave heater, the quartz sleeve is arranged to prevent detritus from collapsing to the corresponding waveguide tube to achieve the effect of protecting the magnetron, and the front ends of the microwave heaters are located in through holes in a front end surface of the cutter head and are flushed with a front end surface of the cutter head.

7. The method of claim 6, wherein the microwave plasma applicators are arranged in a straight line, and the length of the microwave plasma applicators is equal to that of the microwave heaters.

8. The method of claim 6, wherein the microwave plasma applicator comprises a power divider, a narrow-side waveguide and a quartz tube, a rear end of the power divider is connected with the corresponding microwave conversion switch through the corresponding waveguide tube, the narrow-side waveguides are respectively mounted at a front end of the power divider, the quartz tubes are fixedly mounted in the through holes in vertical parts of the narrow-side waveguides, air inlets are formed in rear ends of the quartz tubes, plasma torches are respectively mounted in the quartz tubes, and the plasma torches are ejected out from the front ports of the quartz tubes.

9. The method of claim 8, wherein infrared thermal imagers are respectively arranged at middle positions of each cutting heads on the front end surface of the cutter head and the corresponding plasma torch so as to monitor a temperature of the rocks and photograph the surface morphology of the rocks.

* * * * *